US012122969B1

(12) United States Patent
Dedick et al.

(10) Patent No.: US 12,122,969 B1
(45) Date of Patent: Oct. 22, 2024

(54) APPLICATION OF STRUCTURALLY ALTERED GAS MOLECULES FOR TREATMENT OF FOSSIL FUELS AND BIOFUELS

(71) Applicants: H2Plus LLC, San Diego, CA (US); H2Plus Operations, LLC, San Diego, CA (US)

(72) Inventors: Gene Dedick, Grand Junction, CO (US); Jared Roberts, Grand Junction, CO (US)

(73) Assignee: H2Plus LLC, San Diego, CA (US)

( * ) Notice: Subject to any disclaimer, the term of this patent is extended or adjusted under 35 U.S.C. 154(b) by 0 days.

(21) Appl. No.: 18/376,779

(22) Filed: Oct. 4, 2023

(51) Int. Cl.
*C10L 1/12* (2006.01)
*C10L 3/00* (2006.01)

(52) U.S. Cl.
CPC ..... *C10L 1/125* (2013.01); *C10L 3/003* (2013.01); *C10L 2230/22* (2013.01); *C10L 2290/38* (2013.01); *C10L 2290/40* (2013.01)

(58) Field of Classification Search
CPC ..... C10L 1/125; C10L 3/003; C10L 2230/22; C10L 2290/38; C10L 2290/40
See application file for complete search history.

(56) References Cited

U.S. PATENT DOCUMENTS

| | | | | |
|---|---|---|---|---|
| 11,384,440 | B1 | 7/2022 | Roberts et al. | |
| 11,634,823 | B2 | 4/2023 | Roberts et al. | |
| 2004/0149591 | A1* | 8/2004 | Klein | C01B 3/0094 205/628 |
| 2008/0257719 | A1* | 10/2008 | Suratt | C02F 1/46109 204/272 |
| 2009/0090312 | A1 | 4/2009 | Stehl et al. | |
| 2014/0259922 | A1* | 9/2014 | Benitez | C10L 3/00 48/180.1 |
| 2016/0304480 | A1 | 10/2016 | Hwang et al. | |

FOREIGN PATENT DOCUMENTS

WO 2020253783 12/2020

OTHER PUBLICATIONS

Libretexts, The Bonds in Water, date unknown, pp. 1.11.1-1.11.8 (Year: 0000).*

* cited by examiner

*Primary Examiner* — Cephia D Toomer
(74) *Attorney, Agent, or Firm* — Georgiy L. Khayet

(57) ABSTRACT

Methods and systems for fuel treatment are provided. An example method includes generating structurally altered gas molecules from water. The structurally altered gas molecules have a higher probability of attraction of electrons into areas adjunct to the structurally altered gas molecules than molecules of the water. The method further includes infusing the structurally altered gas molecules into a fuel to modify properties of the fuel, thereby increasing fuel burning efficiency.

10 Claims, 5 Drawing Sheets

302

| Greenhouse Gas | Formula | 100-year GWP (AR4) |
|---|---|---|
| Carbon dioxide | $CO_2$ | 1 |
| Methane | $CH_4$ | 25 |
| Nitrous oxide | $N_2O$ | 298 |
| Sulphur hexafluoride | $SF_6$ | 22,800 |

FIG. 3

APPLICATION OF STRUCTURALLY ALTERED GAS MOLECULES FOR TREATMENT OF FOSSIL FUELS AND BIOFUELS

TECHNICAL FIELD

This disclosure relates to fuel treatment. More specifically, this disclosure relates to methods for treatment of fossil fuels and biofuels.

BACKGROUND

Fossil fuel (e.g., coal, oil, and natural gas) and biofuel react with oxygen in the air when burned, forming a number of products. In its simplest form, this chemical reaction can be written as follows: Fuel+Oxidizer→Product. This reaction always produces heat. Chemical reactions that produce heat are called exothermic reactions. In addition to carbon and hydrogen, fossil fuels may contain oxygen and traces of other elements, such as sulfur and metals, which may complicate the combustion. Assuming that all impurities have been removed and the reactions are such that all the fuels are burned to produce carbon dioxide and water vapor, an example of methane, gasoline, and coal burn in oxygen would be as follows. Methane: $CH_4+2O_2 \rightarrow CO_2+2\ H_2O$; Gasoline: $C_8H_{18}+12.5\ O_2 \rightarrow 8\ CO_2+9\ H_2O$; and Coal: $C+O_2 \rightarrow CO_2$.

Such reactions, where the oxidizer is just enough to convert all fuels to carbon dioxide and water vapor, are called stoichiometric. When the reactant mixture has fuel or oxygen in excess of what is required for stoichiometric ratio, the mixture is fuel rich (oxygen lean) or oxygen rich (fuel lean), respectively. If air were used instead of oxygen, the reaction would remain the same except that the nitrogen in the air would appear unburned in the product. For example, the stoichiometric combustion of gasoline in air would be: $C_8H_{18}+12.5\ (O_2+3.76N_2) \rightarrow 8\ CO_2+9\ H_2O+47.0N_2$ (air is a mixture of 1 part oxygen and 3.76 parts nitrogen).

On the mass basis: 114 kg gasoline+1,716 kg air→352 kg carbon dioxide+162 kg water vapor+1,316 kg nitrogen, or 1 kg gasoline+15.1 kg air→3.1 kg carbon dioxide+1.42 kg water vapor+11.54 kg nitrogen.

Although methane and gasoline have very different structures, they have a similar air/fuel ratio and produce roughly the same amount of carbon dioxide per mass of fuel burned.

The notion of "carbon dioxide equivalents" ($CO_2e$) is used to measure and compare emissions from greenhouse gases based on how severely they contribute to global warming. Metrics for $CO_2e$ show how much a particular gas contribute to global warming if it were carbon dioxide. The metric is typically measured in millions of metric tons. Gases like methane, nitrous oxide, ozone, and water vapor are thought to be causing rising temperatures and climate change.

Additionally, some conventional fuel treatment systems apply addition of nitrogen and/or liquid organic substances such as oxygenates to bring fuel properties into specification (American Petroleum Institute (API) gravity, density, and so forth). However, these methods provide minimal energy efficiency increases, but in turn release more $CO_2e$ into the environment when the fuel combusts.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

According to one example embodiment of the present disclosure, a method for fuel treatment is provided. The method may include generating structurally altered gas molecules from water. The structurally altered gas molecules have a higher probability of attraction of electrons into areas adjunct to the structurally altered gas molecules than molecules of the water. The method may further include infusing the structurally altered gas molecules to a fuel to modify properties of the fuel, thereby increasing fuel burning efficiency.

According to another embodiment of the present disclosure, a system for fuel treatment is provided. The system may include a generator configured to generate structurally altered gas molecules from water. The structurally altered gas molecules have a higher probability of attraction of electrons into areas adjunct to the structurally altered gas molecules than molecules of the water. The system may further include a mixing chamber for infusing the structurally altered gas molecules to a fuel to modify properties of the fuel, thereby increasing fuel burning efficiency.

Other example embodiments of the disclosure and aspects will become apparent from the following description taken in conjunction with the following drawings.

BRIEF DESCRIPTION OF DRAWINGS

Exemplary embodiments are illustrated by way of example and not limitation in the figures of the accompanying drawings, in which like references indicate similar elements.

FIG. 3 is a table illustrating emissions from fossil and biofuels expressed in $CO_2e$.

DETAILED DESCRIPTION

Figure 1:
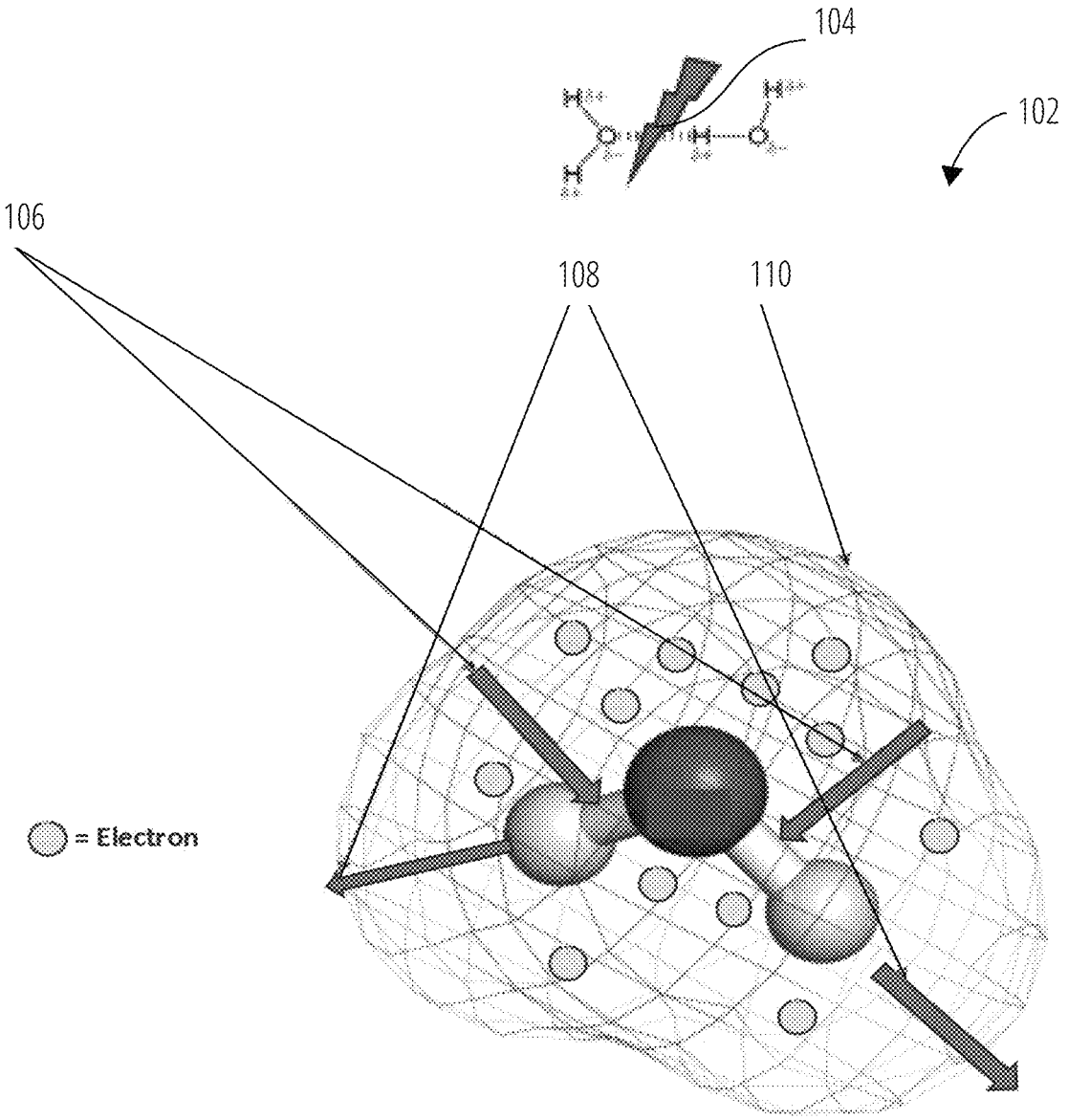
FIG. 1 shows a structurally altered gas molecule 102 deployed in the method for fuel treatment, according to an example embodiment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of this disclosure relate to methods for fuel treatment. Specifically, the embodiments of this disclosure relate to methods for application of a structurally altered gas molecule to optimize efficiency and minimize $CO_2$e release from the processing and combustion of carbon-based fossil fuels and biofuels upstream and downstream of their respective integrated refining processes.

The method results in efficiency increase and resulting $CO_2$e reduction in the combustion of fossil fuels and biofuels. The method uses conventional water treatment technologies to generate a purified liquid. That liquid is added to a chemical reaction chamber that contains an electrolyte solution. This mixture is treated by a focused magnetic field using a magnetic field generator and an electric field to generate an altered, gaseous form of the purified liquid. The generated altered water molecule gas can then be deployed directly into the gas prior to combustion of the fossil and or biofuels or mixed with the same fuels of liquid form to increase power efficiency and/or reduce $CO_2$e emissions to the environment.

Components involved in a method described in the present disclosure include water, water pretreatment equipment, a chemical reaction chamber, an electrolyte solution, a magnetic field generator, and electricity. Additional components may include pressure regulators, an electrical inverter, solar panels, and a gas diffuser for diffusing gas into atmosphere or liquid that living cells can interface with and uptake the altered water molecule in gaseous and/or liquid form.

Water serves as the raw material that the gas product is generated from. Water pretreatment equipment is used to prepare the water for the reaction chamber using such steps as conventional filtration, absorption, and purification. The reaction chamber provides the reaction vessel that holds the electrolyte solution and the purified water for the magnetic field to chemically convert the purified water into an altered gaseous form of the purified liquid. The electrolyte solution provides the medium for the magnetic field to align and impart its energy on the purified water mixed in with the electrolyte solution to chemically generate the altered gaseous form of the water. In an example embodiment, the magnetic field generator may include one of the following: earth magnets, solenoids, electromagnets, and so forth. The magnetic field generator creates magnetic field to drive the chemical reaction that generates the altered form of the gaseous water. Once generated, the gas can be diffused into the upstream and/or recycled liquid feed stream. The gas can be deployed directly into the gaseous fossil and biofuels and/or diffused into liquid fossil and biofuels that, in either case, the gas is provided to the combustor to increase power efficiency and/or reduce $CO_2$e emissions to the environment.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

This application makes reference to U.S. patent application Ser. No. 17/487,613, filed on Sep. 28, 2021, now U.S. Pat. No. 11,384,440, and to U.S. patent application Ser. No. 17/743,632, filed on May 13, 2022, now U.S. Pat. No. 11,634,823, the subject matter of which is incorporated herein by reference in its entirety for all purposes. Processes and systems described herein may be better understood in light of the concepts found in these references.

FIG. 1 shows a structurally altered gas molecule 102 deployed in the method according to the present disclosure. The structurally altered gas molecule deployed in the method according to the present disclosure may include a structurally altered gas molecule generated by processes described in U.S. Pat. Nos. 11,384,440 and 11,634,823.

During the alterations, hydrogen bonds 104 are broken to allow a gaseous single molecule form of water to exist and enable the following adjustments: 1) a bond angle 106 is decreased; 2) oxygen-hydrogen covalent bond length 108 is increased; 3) adjustments allow room for more electrons in probability spheres 110. Per the molecular orbital theory (MOT)e, small molecules like water can adjust electron energy levels around the probability spheres. The MOT states that not just the atoms themselves but the entire molecule shares electrons now.

As for the structurally altered gas molecule 102, the molecular alterations include lengthening of the H—O bonds from 0.95 Angstroms up to 1.3 Angstrom and decreasing the H—O—H bond angle from 104.5° to as small as 94°. These changes alter the chemical properties of the water that the gas may be infused into. These changes include a decrease in normal pure water pH (from 7.0 to ~6.5), and a shift in redox potential from 0 mV to ~−200 mV. This gas has been diffused into normal pure water where it has been demonstrated that the infused gas imparts some of its above-described properties to the un-gassed normal pure water.

The gas, i.e., structurally altered gas molecules, has been diffused into normal pure water where it has been demonstrated that the gas imparts its above-described properties to the un-gassed normal pure water. The restructuring of normal water molecules by diffusion of the gas into it has shown the following observed alterations in the gas diffused water allowing the accommodation of excess electrons. The first alteration is reduction in intermolecular hydrogen bonding between water molecules in liquid phase. Hydrogen bonding in water is a dynamic attraction between positively charged hydrogen atoms of one water molecule and negatively charged oxygen atoms of another water molecule. This occurs because of the difference in electronegativity between hydrogen and oxygen atoms.

The second alteration is reduction in the dipole moment of the gas treated water. The dipole moment is a measure of the separation of positive and negative electrical charges within a system. Water has a dipole moment because water has a bent structure and the electronegativity difference between atoms of oxygen and hydrogen.

The third alteration is reduction in the ion-dipole force formed between ions and water. The ion-dipole force is a force of attraction between an ion and a neutral molecule that has a dipole.

The fourth alteration is formation of hydrated electrons from the surplus excess electrons provided by the infusion of the structurally altered gas molecules. Hydrated electrons form when an excess of electrons is injected into liquid water.

These alterations reduce the tendency of the water molecules to "clump" through hydrogen bonding, and its dipole moment. The alterations also provide a reduction in the ion-dipole force formed between ions and water to facilitate a surplus availability of electrons.

Figure 2:
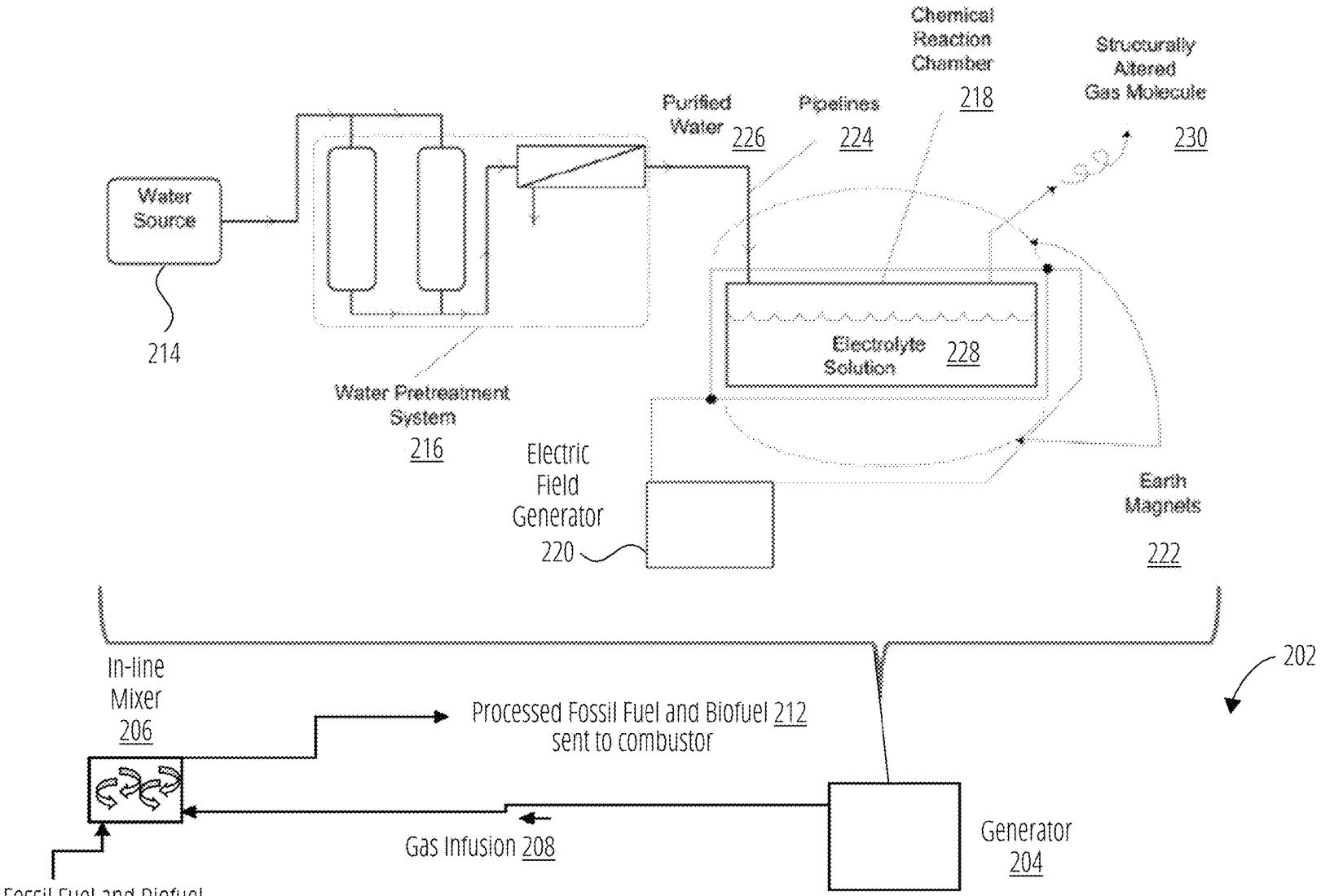
FIG. 2 is a diagram showing a system 202 for fuel treatment, according to an example embodiment.

FIG. 2 is a diagram showing a system 202 for fuel treatment, according to an example embodiment. The system 202 may include a fossil and biofuel technology generator shown as a generator 204 and a mixing chamber shown as an in-line mixer 206.

A fossil fuel and biofuel 210 may be provided to the in-line mixer 206. The water infused with structurally altered gas molecules generated by the generator 204 may be provided in form of gas infusion 208 to the in-line mixer 206. The in-line mixer 206 may be configured to infuse the structurally altered gas molecules from the gas infusion 208 to the fossil fuel and biofuel 210 to modify properties of the fossil fuel and biofuel 210, thereby increasing fuel burning efficiency. Upon infusing the structurally altered gas molecules into the fossil fuel and biofuel 210, processed fossil fuel and biofuel 212 may be produced. The processed fossil fuel and biofuel 212 may be sent to a combustor.

The generator 204 is an example system for generating a structurally altered gas molecule, according to an example embodiment. The generator 204 may include a water source 214, a water pretreatment system 216, a chemical reaction chamber 218, an electric field generator 220, the magnetic field generator such as earth magnets 222, and pipelines 224. The generator 204 may also include pressure regulators. The electric field generator 220 may include an electrical inverter and solar panels.

The water source 214 may provide water as a raw material for generating the gas molecule product. The water pretreatment system 216 may prepare the water for the chemical reaction chamber 218. The water pretreatment system 216 may include a filtration system, an absorption system, and a purification system to produce the purified water 226.

The chemical reaction chamber 218 may be configured to accommodate water and may contain an electrolyte solution 228. The electrolyte solution 228 can be made using a mixture of a hydroxide salt and an acid salt. The purified water 226 can be provided to the chemical reaction chamber 218. The earth magnets 222 may generate a permanent focused magnetic field. The electric field generator 220 may generate an electric field. The focused magnetic field and the electrical field may drive a chemical reaction that generates the structurally altered gas molecule 230 from the purified water supplied into the chemical reaction chamber 218. The electrolyte solution 228 may provide a medium for the focused magnetic field to align and impart energy of the focused magnetic field on the purified water mixed in with the electrolyte solution and, thereby, chemically generate the structurally altered gas molecule 230 from the purified water 226. The temperature in the chemical reaction chamber 218 can be from 60 degrees to 120 degrees Fahrenheit. The pressure in the chemical reaction chamber 218 can be from 1 atmosphere to 40 pounds per square inch gauge (psig). The structurally altered gas molecule 230 may have a higher probability of attraction of electrons into areas adjunct to the structurally altered gas molecule 230 than molecules of the water.

The structurally altered gas molecule 230 can be 99.9% hydrogen and oxygen combination in two parts of hydrogen to one part of oxygen ratio at the Standard Temperature of 68 degrees of Fahrenheit and Pressure of 1 atmosphere (STP). The structurally altered gas molecule 230 may have the O—H bond length between 0.95 and 1.3 angstroms and the H—O—H bond angle between 94 degrees and 104 degrees.

The molecular weight of the structurally altered gas molecule 230 can be between 12.14 and 12.18 atomic mass units (AMUs) at STP. In comparison, the molecular weight of pure water vapor is 18 AMUs at STP. At STP, the relative density of the structurally altered gas molecule 230 compared to dry air is 41.18%-42.00%. In comparison, relative density of pure water vapor compared to dry air is 62.19%. The structurally altered gas molecule 230 may remain stable at pressure more than 300 psig.

When dissolved in pure water having 2 parts per million (ppm) of total dissolved solids (TDS) at 25 degrees of Celsius, the structurally altered gas molecule 230 may generate an ORP of approximately −50 to −360 mV and a pH of 6.1 to 6.8 in the resulting gas-water mixture. The ORP and pH may remain stable in a closed insoluble vessel for at least 30 days. In comparison, the pure water does not possess a stable negative ORP at a pH below 7.

When dissolved in pure water (2 ppm TDS at 25 degrees Celsius), the structurally altered gas molecule 230 may reduce the concentration of TDS from 2.0 ppm to 1.0 ppm, i.e., the reduction is 50%. Barring contamination, the concentration of TDS remains stable at 1 ppm in a closed insoluble vessel indefinitely.

The changes in structure and properties of the structurally altered gas molecule 230 are caused by changes in electronic structure of the gas structurally altered structurally altered gas molecule 230 due to applying the focused magnetic field and the electrical field to the mixture of the electrolyte solution 228 and purified water 226.

In an example embodiment, the system 202 may include diffusers of gas to atmosphere or to liquid deployment systems to apply the gas in a way that enables living organisms to interface with and uptake the structurally altered gas molecules.

In an example embodiment, a structurally altered gas molecule 230 used in the method for fuel treatment is a combination of two parts of hydrogen and one part of oxygen and produced from water. The structurally altered gas molecule 230 is produced by placing an electrolyte solution in a chemical reaction chamber, adding purified water to the chemical reaction chamber, and applying a focused magnetic field generated by the magnetic field generator and an electric field to a mixture of the purified water and the electrolyte solution to cause generation of the structurally altered gas molecule from the purified water. The temperature in the chemical reaction chamber may be from 60 degrees to 120 degrees Fahrenheit. The pressure in the chemical reaction chamber may be from 1 atmosphere to 40 psig. The structurally altered gas molecule 230 has a hydrogen-oxygen-hydrogen bond angles between 94 degrees and 104 degrees and hydrogen-oxygen bond length between 0.95 Angstrom and 1.3 Angstrom. A hydrogen bonding of the structurally altered gas molecule 230 is neutralized. The structurally altered gas molecule 230, when being dissolved in water, may have two parts per million (ppm) of TDS, causing the TDS to reduce to one ppm. When being dissolved in the purified water, the structurally altered gas molecule 230 and the water may form a solution having a pH ranging from 6.1 to 6.8.

The structurally altered gas molecule 230 may be produced with a mixture of a hydroxide salt and an acid salt as the electrolyte. The structurally altered gas molecule 230 may have a density relative to a dry air of from 41.18% to 42%. The structurally altered gas molecule 230 may be stable at a pressure exceeding 300 psig. The structurally altered gas molecule 230 may have a peak at 600 inverse centimeters in an infrared spectrum.

In an example embodiment, upon dissolving the structurally altered gas molecule 230 in water, a solution of the structurally altered gas molecule 230 and water is produced. The solution may have an oxidation/reduction potential of −50 to −360 millivolts and pH from 6.1 to 6.8. The oxidation/reduction potential and the pH may remain stable for at least 30 days after the solution is placed in a closed insoluble vessel. When infused in water, the structurally altered gas molecule 230 may cause a hydrogen bonding in the water to be neutralized.

FIG. 3 is a table 302 illustrating emissions from fossil and biofuels expressed in $CO_2$e. Incomplete combustion creates more $CO_2$e such as methane and carbon monoxides. More specifically, incomplete combustion (where there is not enough oxygen present) can lead to the formation of carbon, methane, or carbon monoxide. The hydrogen in the hydrocarbon gets the first chance at the oxygen, and the carbon gets whatever is left over. The presence of glowing carbon particles in a flame turns it yellow, and black carbon is often visible in the smoke. Carbon monoxide is produced as a colorless poisonous gas. If chemical reactions are completed fully, there may be little pollution and hydrocarbons may be a relatively minor source of fuel. Unfortunately, these reactions do not reach completion and other gases such as nitric oxides (NO and $NO_2$) and carbon monoxide (CO) are always present. Because reactions take longer to reach completion than the time available in the combustion chamber, some hydrocarbons may also remain unburned in the product. Therefore, products may be exhausted before reaching equilibrium. The degree to which the reaction completes depends upon such variables as the combustion temperature and pressure, residence time, and mixture ratios.

Oxidation reduction reaction in fossil fuels and their contaminants with oxygen-carbon, hydrogen, nitrogen, sulfur give their electrons up to oxygen and become oxidized to form CO, $CO_2$, $H_2O$, $NO_X$, $SO_X$ (collectively called $CO_2$e or $CO_2$ equivalents).

An oxidation-reduction (redox) reaction is a type of chemical reaction that involves a transfer of electrons between two species. An oxidation-reduction reaction is any chemical reaction in which the oxidation number of a molecule, atom, or ion change by gaining or losing an electron.

Redox reactions can also occur when the transfer of electrons is not complete but involves a change in the degree of electron sharing in covalent bonds. In the combustion of methane to form water and carbon dioxide, the nonpolar covalent bonds of methane (C—H) and oxygen (O═O) are converted to polar covalent bonds (C═O and O—H).

Figure 4:
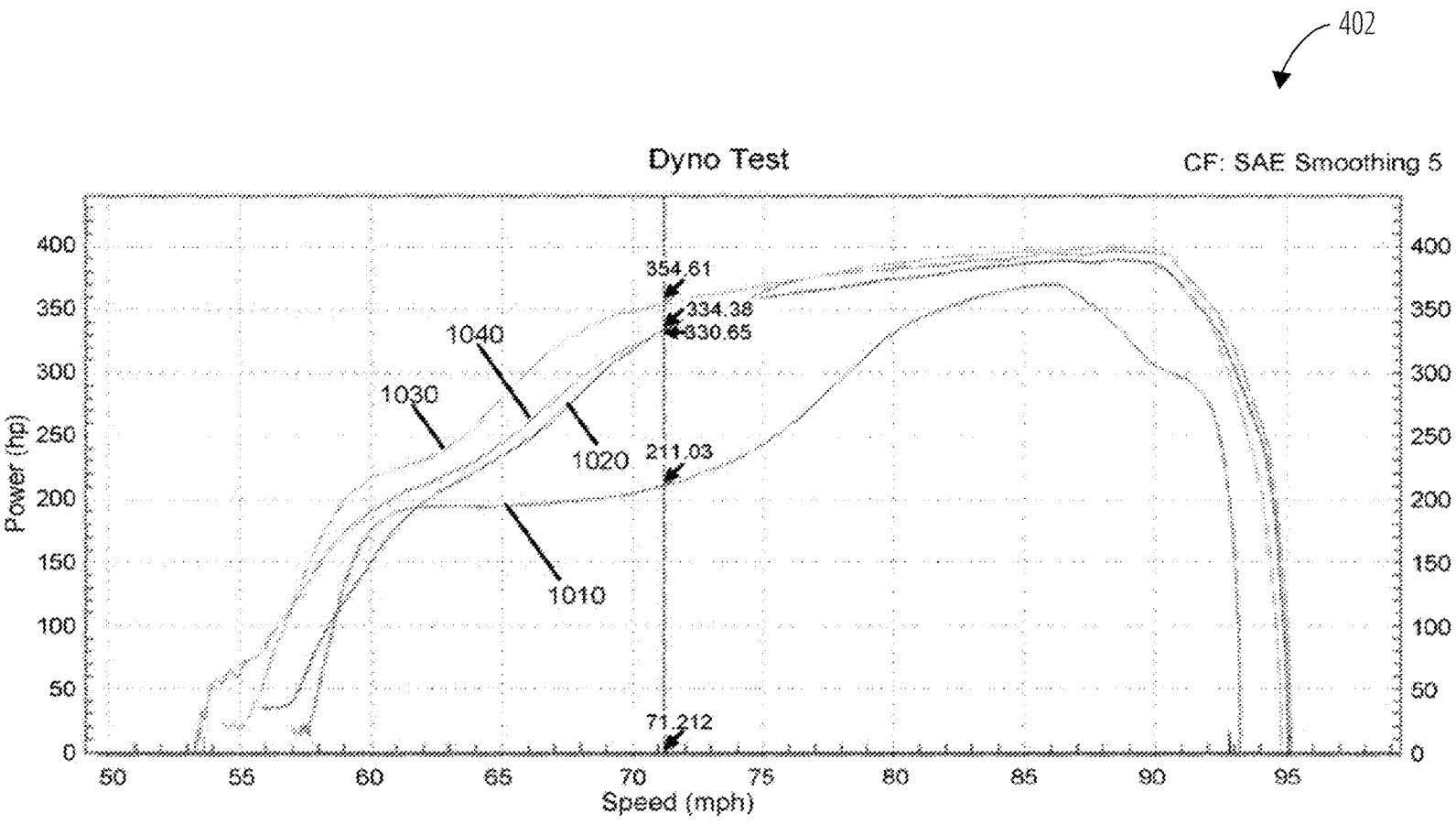
FIG. 4 is a diagram showing a dyno test analysis for octane fuel with and without structurally altered gas molecule infusion.

FIG. 4 is a diagram 402 showing a dyno test analysis for a 110 octane fuel with and without structurally altered gas molecule infusion. The line 1010 represents the untreated fuel (i.e., a fuel not infused with the structurally altered gas molecule) and the lines 1020, 1030, and 1040 are runs of the dyno test on the same 110 octane fuel infused with the structurally altered gas molecule. All dyno tests for the 110 octane fuel infused with the structurally altered gas molecule were performed at the same temperature, pressure, and conditions as those used for the dyno test of the untreated fuel. During the research, there was an average of 37.9% increase in horsepower (hp) at the 71.212 miles per hour mark on the dyno tests with the 110 octane fuel infused with the structurally altered gas molecule.

The empirical evaluation of the emissions associated with the untreated fuel and the 110 octane fuel infused with the structurally altered gas molecule (via a smell test) showed a significant decrease in unburned hydrocarbons and other undesirable emissions and smells shown by the 110 octane fuel infused with the structurally altered gas molecule.

In an example embodiment, the method according to the present disclosure may be applied to fossil and biofuels. The method produces a structurally altered gas molecule that exhibits non-polar properties, and therefore less dipole moment behavior (i.e., less existence of a negatively charged end and a positively charged end). When the structurally altered gas molecule is sufficiently mixed with other non-polar substances such as fossil fuels and biofuels, the structurally altered gas molecule disperse these fossil and biofuel molecules to make them available for a more complete combustion in a shorter time frame in the intended combustion area. The result is higher efficiency, more power and less CO2e formed by completing the combustion from methane and carbon monoxide to a lower CO2e valued product, carbon dioxide, and at the same time the inhibiting the formation of $NO_x$ and $SO_x$. Dyno testing on a fossil fuel engine, with the gas added (see line 1020, 1030, 1040 in FIG. 4) and without, (see line 1010 in FIG. 4) shows a horse power increase of efficiency of approximately 30%.

The abundance of electrons provided by the structurally altered gas molecule provide an environment where the lower activation energies of fossil fuels and biofuels, more specifically hydrogen (57 KJ/mole) and carbon (188 KJ/mole), can be achieved for complete combustion to carbon dioxide $CO_2$ and water $H_2O$. At the same time, there are sufficient available electrons provided by the method according to the present disclosure to inhibit the oxygen from taking the electrons from nitrogen and sulfur, inhibiting them from reaching their relatively higher activation energies to create $NO_2$ (400 KJ/mole) and $SO_2$ (297 KJ/mole). With the higher activation energies, nitrogen and sulfur are not oxidized, oxygen is not reduced, and the $NO_x$ and $SO_x$ compounds are not readily formed during combustion or as present in the exhaust.

The method according to the present disclosure produces a structurally altered gas molecule that exhibits non-polar properties, and therefore less dipole moment behavior (i.e., less existence of a negatively charged end and a positively charged end). When the structurally altered gas molecules are sufficiently mixed with other non-polar substances, such as fossil fuels and biofuels, the structurally altered gas molecules disperse molecules of the fossil and biofuel to make them available for a more complete combustion in a shorter time frame in the intended combustion area. The result is higher efficiency, more power and less $CO_2$e formed by completing the combustion from methane and carbon monoxide to a lower $CO_2$e valued product, carbon dioxide, and at the same time the inhibiting the formation of $NO_x$ and $SO_x$. Dyno testing on a fossil fuel engine as presented in FIG. 4 shows a horse power increase of efficiency of approximately 30%.

The abundance of electrons provided by the structurally altered gas molecule provide an environment where the lower activation energies of fossil fuels and biofuels, more specifically hydrogen (57 KJ/mole) and carbon (188 KJ/mole), can be achieved for complete combustion to carbon dioxide $CO_2$ and water $H_2O$. At the same time, there are sufficient available electrons provided by the method according to the present disclosure to inhibit oxygen from taking the electrons from nitrogen and sulfur, inhibiting them from reaching their relatively higher activation energies to create $NO_2$ (400 KJ/mole) and $SO_2$ (297 KJ/mole). With the higher activation energies, nitrogen and sulfur are not oxidized, oxygen is not reduced, and the $NO_x$ and $SO_x$ compounds are not readily formed during combustion or as present in the exhaust.

Figure 5:
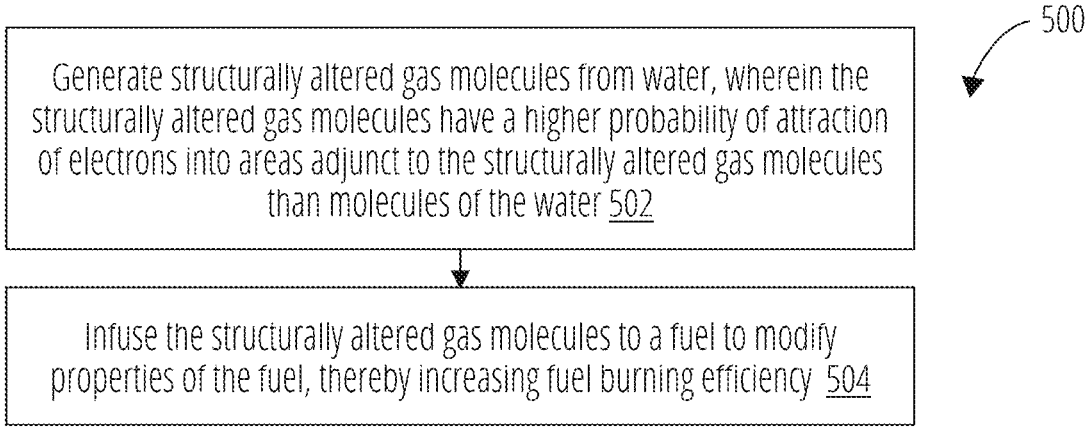
FIG. 5 is a flow chart of a method for fuel treatment, according to an example embodiment.

FIG. 5 is a flow chart of a method 500 for fuel treatment, according to an example embodiment. In some embodiments, the operations of the method 500 may be combined, performed in parallel, or performed in a different order. The method 500 may also include additional or fewer operations than those illustrated.

In block 502, the method 500 may commence with generating structurally altered gas molecules from water. The structurally altered gas molecules have a higher probability of attraction of electrons into areas adjunct to the structurally altered gas molecules than molecules of the water.

In an example embodiment, the generation of structurally altered gas molecules may include placing an electrolyte solution in a chemical reaction chamber, adding purified water to the chemical reaction chamber, and applying a focused magnetic field and an electric field to a mixture of the purified water and the electrolyte solution to cause generation of the structurally altered gas molecule from the purified water. The structurally altered gas molecule is a combination of two parts hydrogen and one part oxygen. The structurally altered gas molecule has a hydrogen-oxygen-hydrogen bond angle between 94 degrees and 104 degrees and hydrogen-oxygen bond length between 0.95 Angstrom and 1.3 Angstrom.

In block 504, the method 500 may proceed with infusing the structurally altered gas molecules to a fuel to modify properties of the fuel, thereby increasing fuel burning efficiency.

In an example embodiment, the fuel includes a liquid fossil fuel. In some example embodiments, the fuel includes a gaseous fossil fuel. In an example embodiment, the fuel includes a liquid biofuel. In some example embodiments, the fuel includes a gaseous biofuel.

In an example embodiment, the modification of the properties of the fuel results in an increase of power produced while burning the fuel by 39%. In some example embodiments, the modification of the properties of the fuel results in a decrease of emission of unburned hydrocarbons while burning the fuel. In an example embodiment, the modification of the properties of the fuel results in a decrease of emission of carbon dioxide equivalent while burning the fuel.

In an example embodiment, upon being infused in the fuel, the structurally altered gas molecules disperse molecules of non-polar substances in the fuel, thereby increasing completeness of combustion of the fuel and decreasing a time for the combustion of the fuel.

Thus, systems and methods for fuel treatment have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A method for fuel treatment, the method comprising:

generating structurally altered gaseous water molecules from water, the structurally altered gaseous water molecules having a structural formula H—O—H and having a first covalent bond between an oxygen atom and a first hydrogen atom and a second covalent bond between the oxygen atom and a second hydrogen atom, an angle between the first covalent bond and the second covalent bond being in a range between 94 degrees and 104 degrees, wherein the structurally altered gaseous water molecules have a higher probability of attraction of electrons into areas adjunct to the structurally altered gaseous water molecules than molecules of the water; and infusing the structurally altered gaseous water molecules to a fuel to modify properties of the fuel, thereby increasing fuel burning efficiency.

2. The method of claim 1, upon being infused in the fuel, the structurally altered gaseous water molecules disperse molecules of non-polar substances in the fuel, thereby increasing completeness of combustion of the fuel and decreasing a time for the combustion of the fuel.

3. The method of claim 1, wherein the modification of the properties of the fuel results in an increase of power produced while burning the fuel by 39%.

4. The method of claim 1, wherein the modification of the properties of the fuel results in a decrease of emission of unburned hydrocarbons while burning the fuel.

5. The method of claim 1, wherein the modification of the properties of the fuel results in a decrease of emission of carbon dioxide equivalent while burning the fuel.

6. The method of claim 1, wherein the fuel includes a liquid fossil fuel.

7. The method of claim 1, wherein the fuel includes a gaseous fossil fuel.

8. The method of claim 1, wherein the fuel includes a liquid biofuel.

9. The method of claim 1, wherein the fuel includes a gaseous biofuel.

10. The method of claim 1, wherein:

the generation of the structurally altered gaseous water molecules includes:

placing an electrolyte solution in a chemical reaction chamber;

adding purified water to the chemical reaction chamber; and applying a focused magnetic field and an electric field to a mixture of the purified water and the electrolyte solution to cause generation of the structurally altered gaseous water molecules from the purified water, wherein:

the structurally altered gaseous water molecules are a combination of two parts hydrogen and one part oxygen; and the structurally altered gaseous water molecules have hydrogen-oxygen bond length between 0.95 Angstrom and 1.3 Angstrom.

* * * * *